US008490518B2

(12) United States Patent
Chen et al.

(10) Patent No.: US 8,490,518 B2
(45) Date of Patent: Jul. 23, 2013

(54) OIL FILTER REPLACEMENT DEVICE

(75) Inventors: Lung-Shan Chen, Taichung (TW); Lien-Chin Chen, Taichung (TW); Ching-Fang Chen, Taichung (TW)

(73) Assignee: Shine Yen Industrial Co., Ltd., Taichung (TW)

( * ) Notice: Subject to any disclaimer, the term of this patent is extended or adjusted under 35 U.S.C. 154(b) by 246 days.

(21) Appl. No.: 13/039,319

(22) Filed: Mar. 3, 2011

(65) Prior Publication Data

US 2012/0222522 A1 Sep. 6, 2012

(51) Int. Cl.
*B25B 17/00* (2006.01)
*B25B 13/28* (2006.01)
*B67B 7/15* (2006.01)

(52) U.S. Cl.
USPC ..... 81/57; 81/90.3; 81/3.44

(58) Field of Classification Search
USPC ..... 81/57, 115, 116, 90.2, 90.5, 176.2, 81/176.3, 111, 3.4, 3.44; 8/90.3
See application file for complete search history.

(56) References Cited

U.S. PATENT DOCUMENTS

| | | | | | |
|---|---|---|---|---|---|
| 1,357,935 | A | * | 11/1920 | Argetsinger | 81/115 |
| 2,764,050 | A | * | 9/1956 | Leibowitz | 81/90.2 |
| 4,781,084 | A | * | 11/1988 | Steen et al. | 81/111 |
| D348,814 | S | * | 7/1994 | Pearson | D8/51 |
| 2012/0079919 | A1 | * | 4/2012 | Chen et al. | 81/90.2 |

* cited by examiner

*Primary Examiner* — Hadi Shakeri
(74) *Attorney, Agent, or Firm* — Muncy, Geissler, Olds & Lowe, PLLC

(57) ABSTRACT

According to the present invention, the oil filter replacement device has a number of pins for clamping an oil filter, and the pins are extended eccentrically from corresponding secondary gear members. The secondary gear members are engaged to spin simultaneously by a main gear member. As such, the pins could be adjusted to fit on oil filters of various sizes. Additionally, each pin is rotatable and has at least a flat face. As the pins rolls along the circumference of the oil filter, their flat faces are turned to interface the flat faces around the oil filter. As such, the oil filter is tightly and reliably clamped by the oil filter replacement device, thereby preventing the problem of uneven exertion of force and deforming the oil filter.

3 Claims, 5 Drawing Sheets

OIL FILTER REPLACEMENT DEVICE

TECHNICAL FIELD OF THE INVENTION

The present invention is generally related to oil filter replacement devices, and more particularly to an oil filer replacement device which clamps the oil filter by a number pins interfacing the flat circumferential faces around the oil filter.

DESCRIPTION OF THE PRIOR ART

The replacement of the oil filter of a motor vehicle usually requires a skillful technician using an appropriate tool as the oil filter is installed in a hidden and tight space. Conventionally, the tool contains a socket whose inner wall has a polygonal shape matching the polygonal circumference of the oil filter. By fitting the socket over the oil filter, the socket is engaged by a wrench to loose or fasten the oil filter. However, there are oil filters of various sizes and the tool's socket sometimes does not fit. Additionally, the socket wears down after a period of usage and cannot fit tightly on the oil filter. Therefore, it is not uncommon that a technician is injured due to the unreliable interaction between the socket and the oil filter. The Taiwan Patent No. M383472 teaches an oil filter replacement device that could fit on oil filters of different sizes. However, when the oil filter replacement device exerts too much force, the circumferential surface of the oil filter is often damaged or deformed from the loose coupling between the oil filter and the replacement device.

SUMMARY OF THE INVENTION

To obviate the prior art's shortcoming, a novel oil filter replacement device is provided herein. According to the present invention, a number of pins for clamping an oil filter are extended eccentrically from corresponding secondary gear members which are engaged to spin simultaneously by a main gear member. As such, the pins could be adjusted to fit on oil filters of various sizes.

Additionally, each pin is rotatable and has at least a flat face. As the pins rolls along the circumference of the oil filter, their flat faces are turned to interface the flat faces around the oil filter. As such, the oil filter is tightly and reliably clamped by the oil filter replacement device, thereby preventing the problem of uneven exertion of force and deforming the oil filter.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
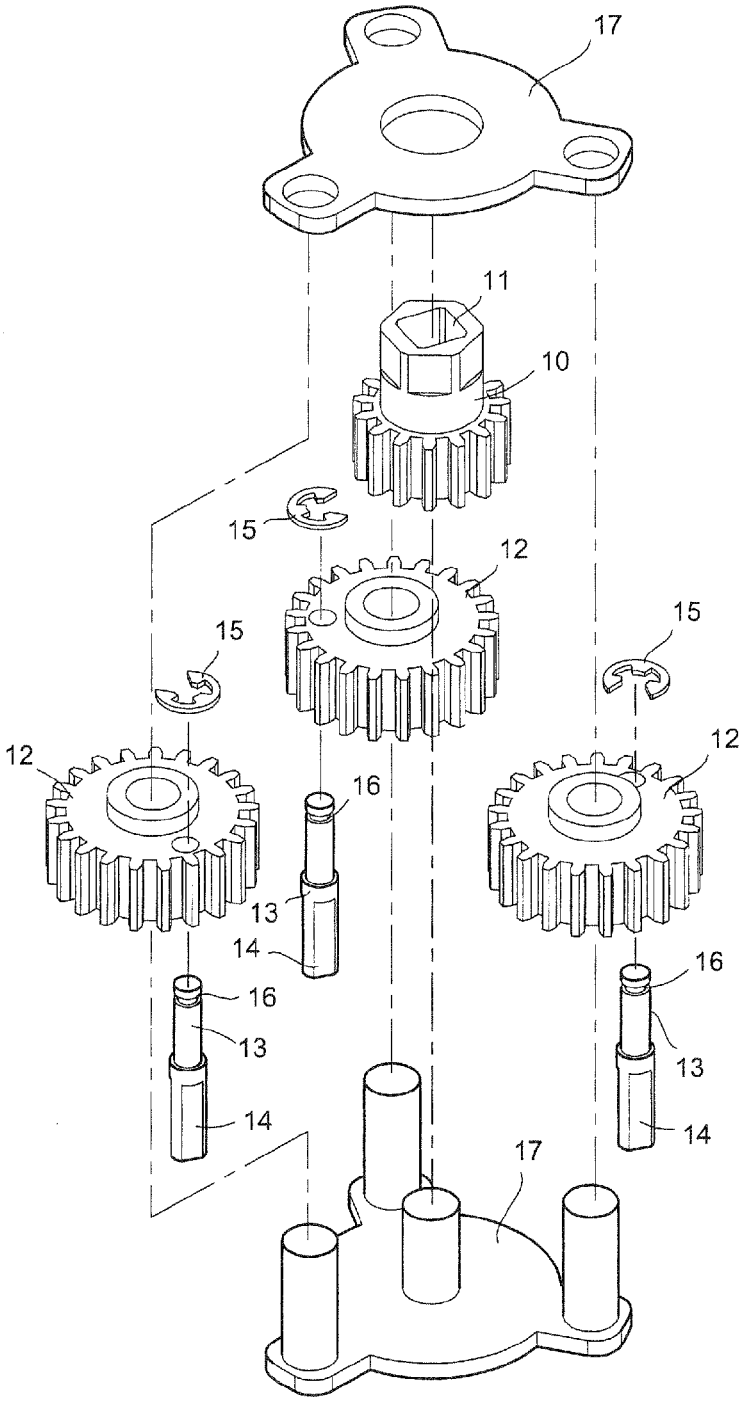
FIG. 1 is a perspective break-down diagram showing the various components of an oil filter replacement device according to an embodiment of the present invention.
Figure 2:
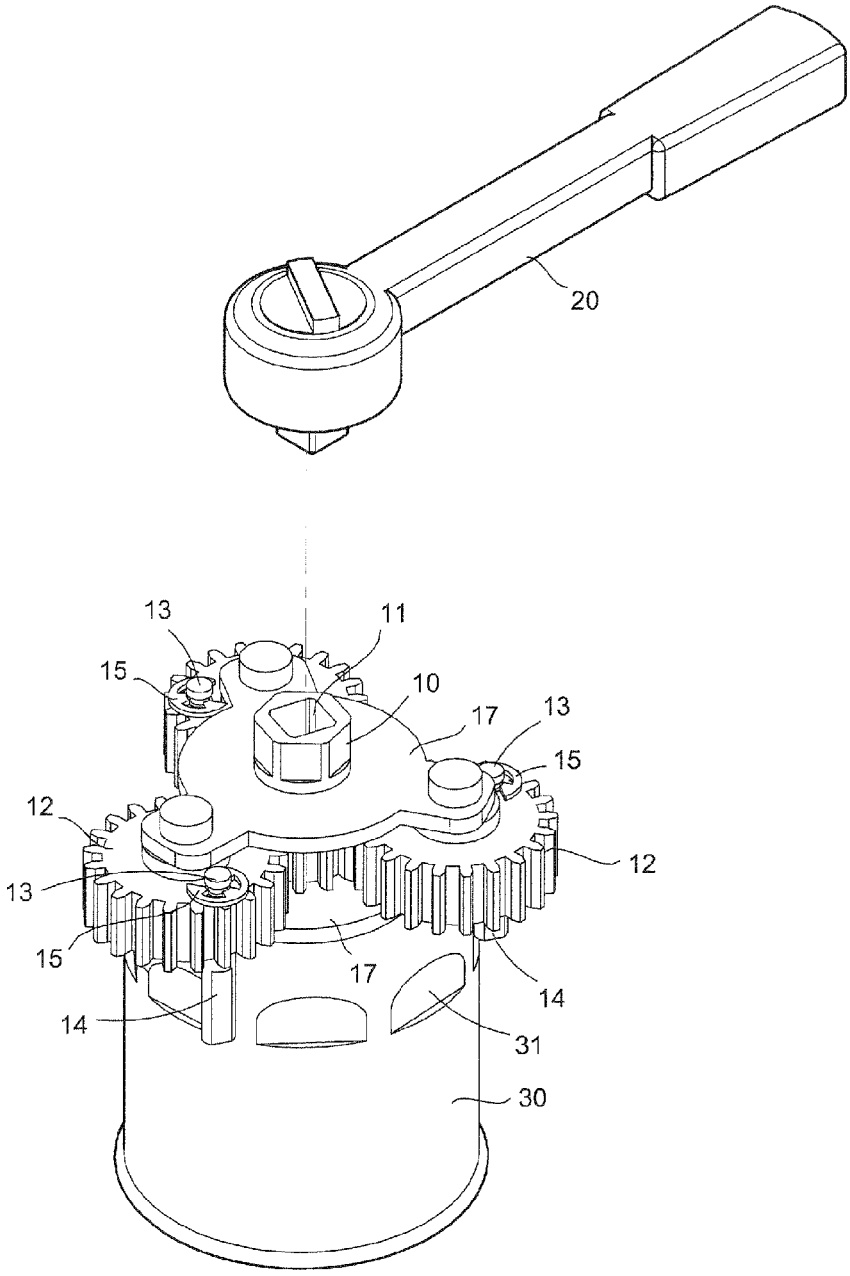
FIG. 2 is a perspective diagram the oil filter replacement device of FIG. 1 is applied to an oil filter by a ratchet wrench.
Figure 3:
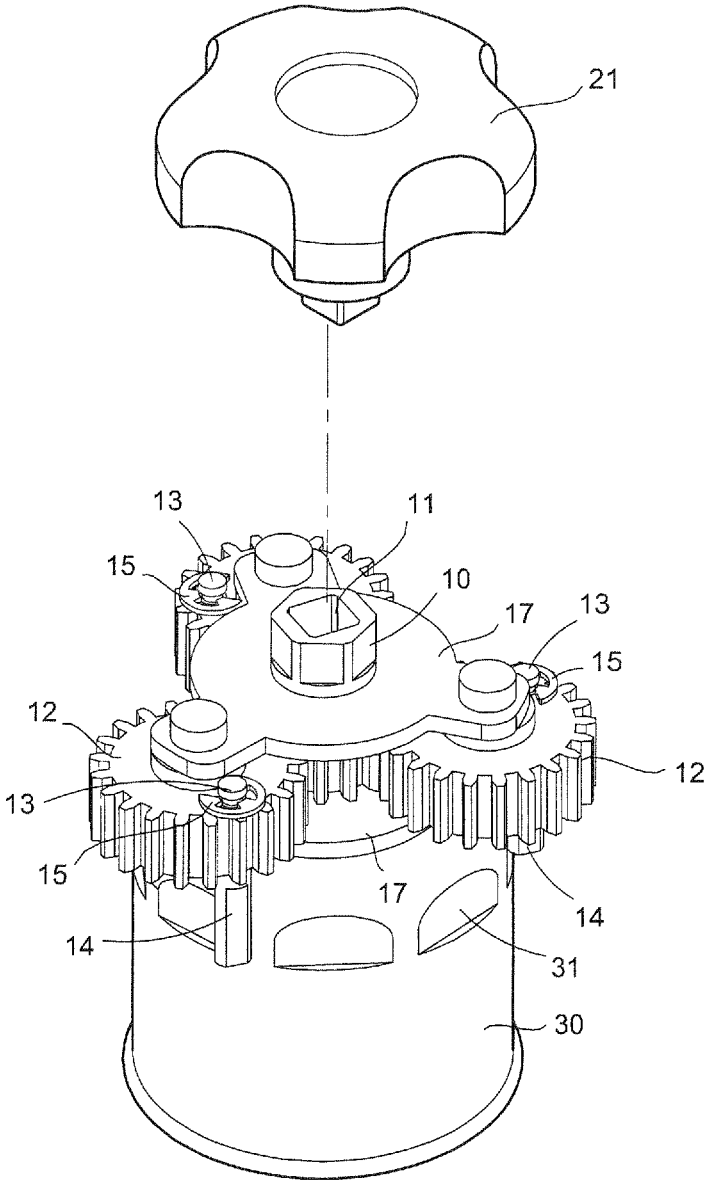
FIG. 3 is a perspective diagram the oil filter replacement device of FIG. 1 is applied to an oil filter by a twisting knob.
Figure 5:
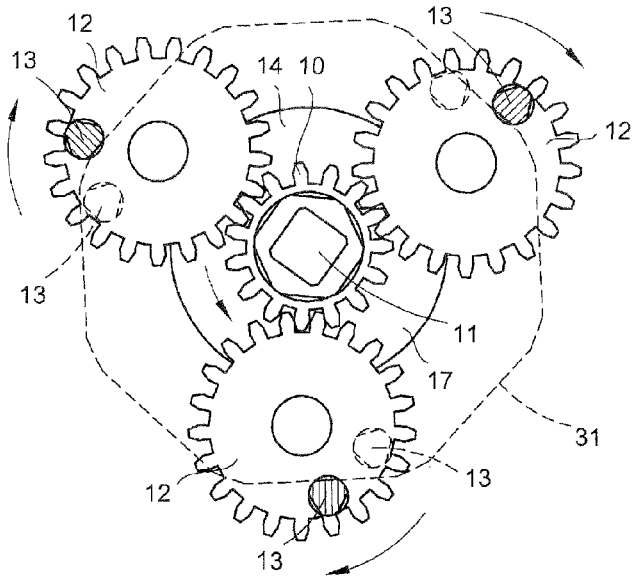
FIG. 5 is a schematic top-view diagram showing the oil filter replacement device of FIG. 1 being applied to an oil filter of a smaller diameter.
Figure 4:
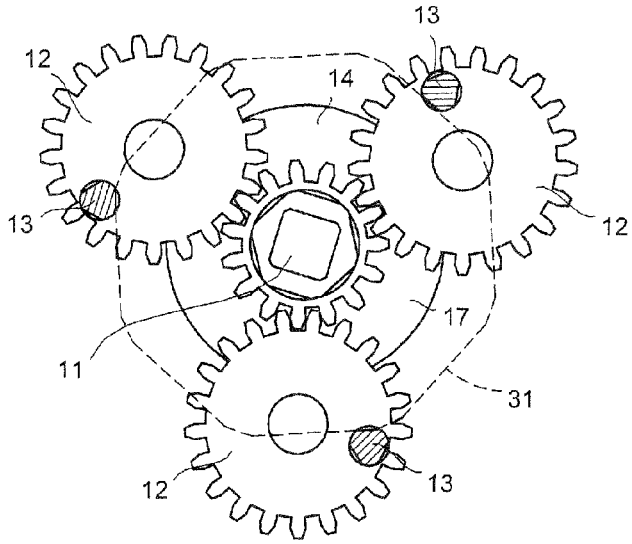
FIG. 4 is a schematic top-view diagram showing the oil filter replacement device of FIG. 1 being applied to an oil filter of a larger diameter
Figure 6:
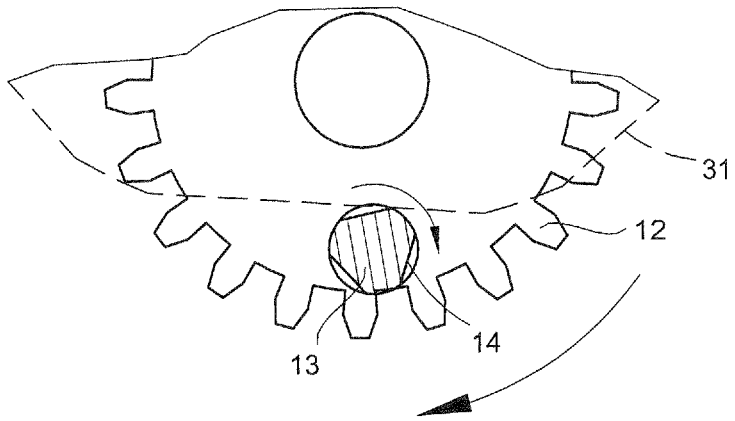
FIGS. 6 and 7 show how a pin of the oil filter replacement device of FIG. 1 engages a flat face of an oil filter.
Figure 7:
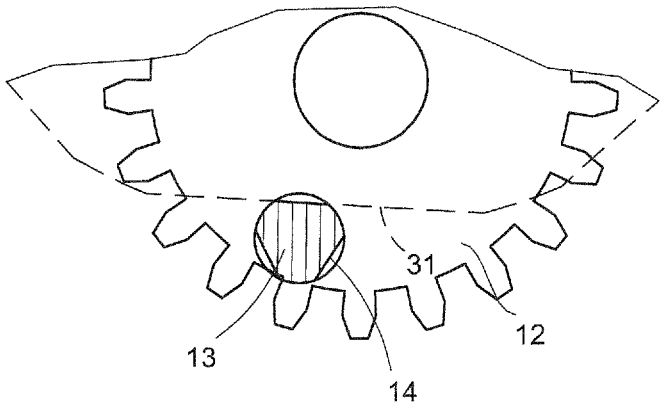

As shown in FIGS. 1 to 7, an oil filter replacement device according an embodiment of the present invention contains a main gear member 10 having an axle with radial cogs around a bottom end and a square socket 11 at a top end. The circumference of the axle around the socket 11 has a polygonal shape. Preferably, the top end of the axle is shaped like a six-point bolt head. As such, a normal ratchet wrench 20 shown in FIG. 2, or a twisting knob 21 shown in FIG. 3 (for operation within a tight space) could be applied to the socket 11 to turn the main gear member 10. The six-point bolt head could also be engaged by an ordinary wrench. The oil filter replacement device further contains a number of secondary gear members 12 equally spaced around the main gear member 10 so that the cogs of the main gear member 10 mesh with those of the secondary gear members 12. Each secondary gear member 12 has a downward extended pin 13 running eccentrically through the interior of the secondary gear member 12. Each pin 13 has a cylindrical upper section for rotatably embedding into a through hole of a secondary gear member 12 and a lower section having at least a flat face 14. Preferably, the lower section is shaped roughly like a triangle prism with three flat faces 14. Each pin 13's top end is extended out of a secondary gear member 12 and a flat clamp piece 15 engages a notch 16 at the top end so as to prevent the pin 13 from falling out of the secondary gear member 12 but still keep the pin 13 rotatable. In alternative embodiments, instead of using separate clamp pieces 15, similar clamping elements are integral parts of the secondary gear members 12. The main and secondary gear members 10 and 12 are sandwiched between a two-piece rack 17 having 4 pivots running through the main and secondary gear members 10 and 12. The main gear member 10 has its top end exposed out of a top piece of the rack 17.

When the oil filter replacement device is applied to an oil filter 30, the pins 13 are naturally attached to the circumference of the oil filter 30. By turning the main gear member 10, the secondary gear members 12 are engaged and rotated. As the pins 13 are rotatable, their flat faces 14 are tuned and finally flatly pressed against the oil filter 30's flat circumferential faces 31, as specifically shown in FIGS. 6 and 7. As such, the oil filter replacement device is tightly and reliably locked to the oil filter 30. By continuously turning the main gear member 10, the oil filter 30 could be fastened or loosed conveniently. The prior art's problem of uneven exertion of force and therefore deforming the oil filter 30 is as such effectively prevented. While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An oil filter replacement device, comprising:

a main gear member having a socket at a top end;

a plurality of secondary gear members equally spaced around said main gear member so that the cogs of said main gear member mesh with the cogs of said secondary gear members where each secondary gear member has a downward extended pin, each pin has a cylindrical upper section for rotatably embedding into an offset through hole of a secondary gear member and a lower section having at least a flat face; and a two-piece rack where said main and secondary gear members are sandwiched between, said two-piece rack having pivots running through a center of said main and a corresponding center of each of the plurality of secondary gear members, and said main gear member has said socket exposed out of a top piece of said rack.

2. The oil filter replacement device according to claim 1, wherein each pin has three flat faces around said lower section.

3. The oil filter replacement device according to claim 1, wherein each pin's top end is extended out of a secondary gear member, and a clamp means engages a notch at said top end of said pin.

* * * * *